United States Patent [19]

Lawbaugh

[11] 4,027,683

[45] June 7, 1977

[54] DISPOSABLE ASHTRAY LINER AND MATING BOWL

[75] Inventor: J. Medley Lawbaugh, South Gate, Calif.

[73] Assignee: The Raymond Lee Organization, Inc., New York, N.Y.

[22] Filed: Nov. 28, 1975

[21] Appl. No.: 635,966

[52] U.S. Cl. ..... 131/235 R; 131/256

[51] Int. Cl...... A24F 13/18; A24F 19/14

[58] Field of Search ..... 131/235.2, 231, 237, 131/240 R, 241, 256; 220/65, 1 H

[56] References Cited

UNITED STATES PATENTS

| | | | |
|---|---|---|---|
| 2,737,956 | 3/1956 | Casper | 131/235 R |
| D152,656 | 2/1949 | Schwisow | 131/235 R |

FOREIGN PATENTS OR APPLICATIONS

| | | | |
|---|---|---|---|
| 422,431 | 1/1935 | United Kingdom | 131/235 R |
| 673,529 | 6/1952 | United Kingdom | 131/235 R |

*Primary Examiner*—Stephen C. Pellegrino
*Attorney, Agent, or Firm*—Stephen Wyden

[57] ABSTRACT

A bowl with a lip in which a liner is inserted, the liner having round bottomed slots to hold cigarettes and snuffing inserts in the bottom to put out the cigarette.

5 Claims, 2 Drawing Figures

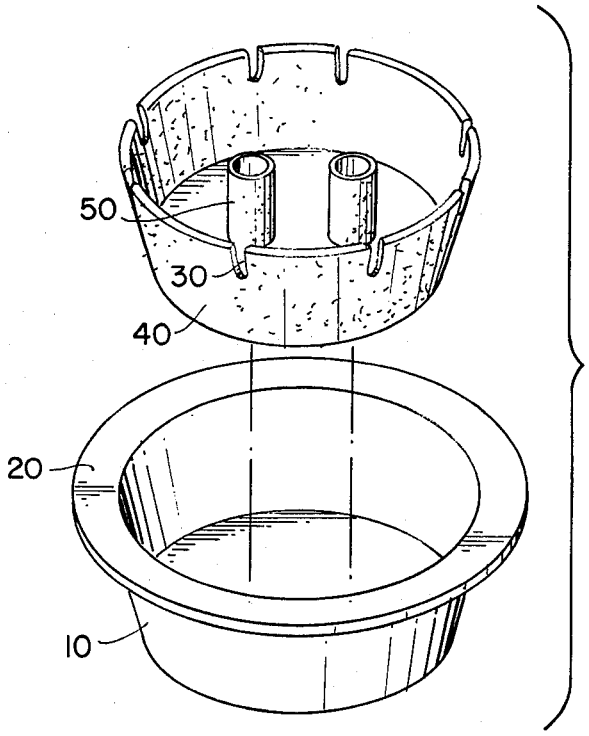
FIG. 1
FIG. 2
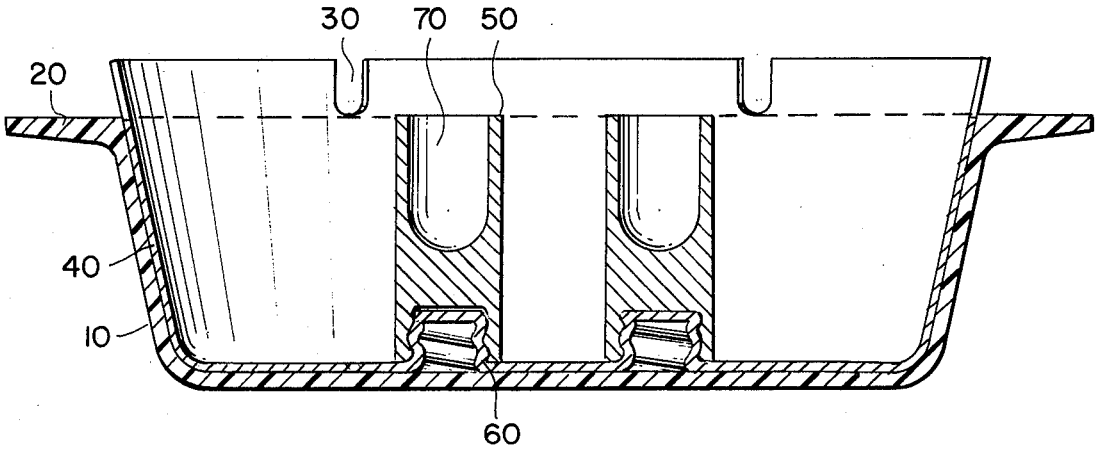

DISPOSABLE ASHTRAY LINER AND MATING BOWL

I have invented a new and novel disposable ashtray liner and mating bowl. My liner has a removable insert for snuffing out cigarettes. This makes the extinguishing of cigarettes neater and more convenient. Since the liners are disposable, the unpleasant task of cleaning ashtrays is thereby eliminated. Just remove the used liner, dispose of it and insert a new liner. The liners may be manufactured of fire retardant paper or other suitable materials.

My invention can be understood in view of the accompanying figures.

FIG. 1 shows a liner removed from the retaining bowl.

FIG. 2 shows a cross sectional view of the assembled ashtray.

In FIG. 1, the bowl (10) has a lip (20) on which cigarettes can be rested. The cigarettes would extend through the round bottomed slots (30) in the liner (40) so the burning end of the cigarette would rest over the inside of the liner (40) where the ashes can be safely and neatly retained. Snuffing inserts, (50) are mounted on the inside bottom of the liner (40).

In FIG. 2, the bowl (10) and lip (20) enclose the base of the liner (40) which extends so the bottom of the round bottomed slots (30) are at the same height as the top of the lip (20). The cigarette snuffing inserts (50) can be seen to be screwed into mating stubs (60) in the bottom of the liner (40). A hollow cylindrical depression (70) in the top of one of the snuffing inserts (50) permits a cigarette to be neatly extinguished. The inserts can also be attached to the liner by a snap-on means or by adhesive.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A disposable ashtray liner and mating bowl, comprising:

a bowl forming a lip on an upper edge, a liner inserted in the bowl, the liner forming a side that rises above the lip of the bowl forming a round bottomed slot, the bottom of the slot at the same level as the top of the tip, the bottom of the liner forming a stub, a cigarette snuffing insert attached to the stub, and the cigarette snuffing insert forming a hollow cylindrical depression in a top of the insert.

2. The disposable ashtray liner of claim 1, wherein the liner is made of fire retardant paper.

3. The disposable ashtray liner and mating bowl of claim 1, wherein the cigarette snuffing insert is screwingly attachable to the stub.

4. The disposable ashtray liner and mating bowl of claim 1, wherein the cigarette snuffing insert is snapably attachable to the stub.

5. The disposable ashtray liner and mating bowl of claim 1, wherein the lip is a horizontally flared lip, whereby a cigarette may be held in the slot.

* * * * *